US005672067A

United States Patent [19]

Ryll et al.

[11] Patent Number: 5,672,067

[45] Date of Patent: Sep. 30, 1997

[54] ELECTRICAL CONNECTOR HAVING A MATING SLIDE WITH CUSTOMIZED CAMMING SLOT

[75] Inventors: Jürgen Ryll, Egelsbach; Michael Schwäger, Mörfelden, both of Germany

[73] Assignee: The Whitaker Corporation, Wilmington, Del.

[21] Appl. No.: 580,003

[22] Filed: Dec. 20, 1995

[30] Foreign Application Priority Data

Jan. 10, 1995 [GB] United Kingdom ..... 9500374

[51] Int. Cl.[6] ..... H01R 13/62

[52] U.S. Cl. ..... 439/157; 439/160

[58] Field of Search ..... 439/157, 310, 439/347, 152, 153, 154, 155, 156, 158, 159, 160, 372

[56] References Cited

U.S. PATENT DOCUMENTS

| | | | |
|---|---|---|---|
| 4,586,771 | 5/1986 | Kraemer et al. | 439/157 |
| 4,850,890 | 7/1989 | Kuzuno et al. | 439/310 |
| 5,035,634 | 7/1991 | Hasircoglu et al. | 439/310 |
| 5,474,462 | 12/1995 | Yamanashi | 439/157 |
| 5,478,251 | 12/1995 | Jaklin | 439/157 |

FOREIGN PATENT DOCUMENTS

| | | |
|---|---|---|
| 0 587 174 A2 | 3/1994 | European Pat. Off. . |
| 0 606 152 A2 | 7/1994 | European Pat. Off. . |

*Primary Examiner*—David L. Pirlot
*Assistant Examiner*—Tho Dac Ta
*Attorney, Agent, or Firm*—Driscoll A. Nina

[57] ABSTRACT

An electrical connector for mating with a second complementary connector, wherein the electrical connector comprises a camming slide incorporated therein that cooperates with the complementary connector to draw the connector pair together, where in response to mating displacement of the camming slide, a camming lug is driven along a camming slot and in response to de-mating displacement of the camming slide, the camming lug is driven oppositely along the camming slot the connector being characterized in that in response to the mating displacement the camming lug is driven along a first camming surface and in response to the de-mating displacement the camming lug is driven along a second camming surface. The improved camming slide providing for the greatest mechanical advantage where needed in both the mating and de-mating strokes of the camming slide.

7 Claims, 3 Drawing Sheets

ELECTRICAL CONNECTOR HAVING A MATING SLIDE WITH CUSTOMIZED CAMMING SLOT

BACKGROUND OF THE INVENTION

1. Field of the Invention

This invention relates to electrical connector pairs that incorporate an actuating slide movable transversely to the direction of mating to draw the connector pair together to mate the contacts therein.

2. Description of the Prior Art

Electrical connectors carrying a multitude of contacts are mated with complementary connectors to form an interconnection. As the number of contacts increase, the mating force required to interconnect the connectors also rises. It is known to incorporate mechanical assisting devices for drawing the two connector halves together. These devices may take on the form of a lever or an actuating slide.

Actuating slides typically move transverse to the mating direction of the connectors. The actuating slide is incorporated into one of the connectors and would include either a camming slide or a camming pin while the mating connector half includes the other. It should be appreciated that there is no difference between connector pairs that incorporate the camming pins onto the actuating slide and camming slots into the mating connector verses those connector pairs where the actuating slides include the camming slots and the mating connector includes the camming pins. The relevant issue is that there is relative movement established between the pin and camming groove so that a camming action occurs to draw the halves together. Once the mating pairs are initially positioned together, transverse actuation of the actuating slide results in the mating pair being drawn together.

In order to reduce the force necessary to draw the two connector halves together, the camming slide is constructed to provide mechanical advantage. Initially, the camming slide consisted of a straight slot at an angle to the movement of this actuating slide. It was soon discovered that during the mating of the halves there was not a constant resistance, but instead the stroke included areas of relatively little resistance and areas of relatively high resistance. An early attempt at solving this problem is disclosed in European Patent Application 0 587 174 assigned to the Assignee of the present invention. The disclosed concept incorporates a camming slide having a relatively steep section which would correspond to a low resistance portion of the mating stroke where it is not necessary to have a large mechanical advantage and a shallower section where it is necessary to have greater mechanical advantage in order to overcome the insertion resistance.

In the above mentioned Prior Art devices, the camming slide includes a camming track that has parallel sides sized to receive the camming lug in a sliding fit therebetween. In this configuration, the camming slot may only be customized to achieve the desired mechanical advantages with respect to mating or unmating of the mating connector halves. During mating, the maximum mechanical advantage is typically needed when the mating contacts therein engage one another or the sealing gasket is encountered. In demating the connector halves, the maximum mechanical advantage is necessary at the beginning of the stroke of the camming slide where it is necessary to overcome engagement of the two contacts. As can be imagined, the optimum camming groove configuration for each of these operations varies in that each requires the maximum mechanical advantage toward the beginning of their strokes and less mechanical advantage at the end, or basically opposite each other. The disadvantage with the Prior Art apparatus is that only one of these operations may be optimized.

SUMMARY OF THE INVENTION

It is an object of this invention to provide a camming slot for a mating slide where the camming slot is optimized to provide the most mechanical advantage where it is necessary for both the mating and demating operations, thereby assuring smooth and easy manipulation.

It is another object of this invention to provide a camming groove that is easily incorporable into conventional connector structure.

It is yet another object of this invention to provide a camming slot in a mating slide that operates transversely to the insertion direction of mating connector halves.

These and other objects are accomplished by providing a mating slide having a camming groove with non-parallel sides, thereby providing separate and distinct camming surfaces or mating and demating functions.

It is an advantage of this invention that smooth and easy operation of the mating slide is achievable for both the mating and demating operations associated with a connector pair. It is another advantage that a camming groove according to the present invention is easily and economically incorporated into known connector structure.

It is yet still another advantage of this invention that the camming groove is especially applicable to electrical connector halves mated and demated with a camming slide that operates transverse to the direction of insertion of the mating connector halves.

DETAILED DESCRIPTION OF THE PREFERRED EMBODIMENT

Figure 1:
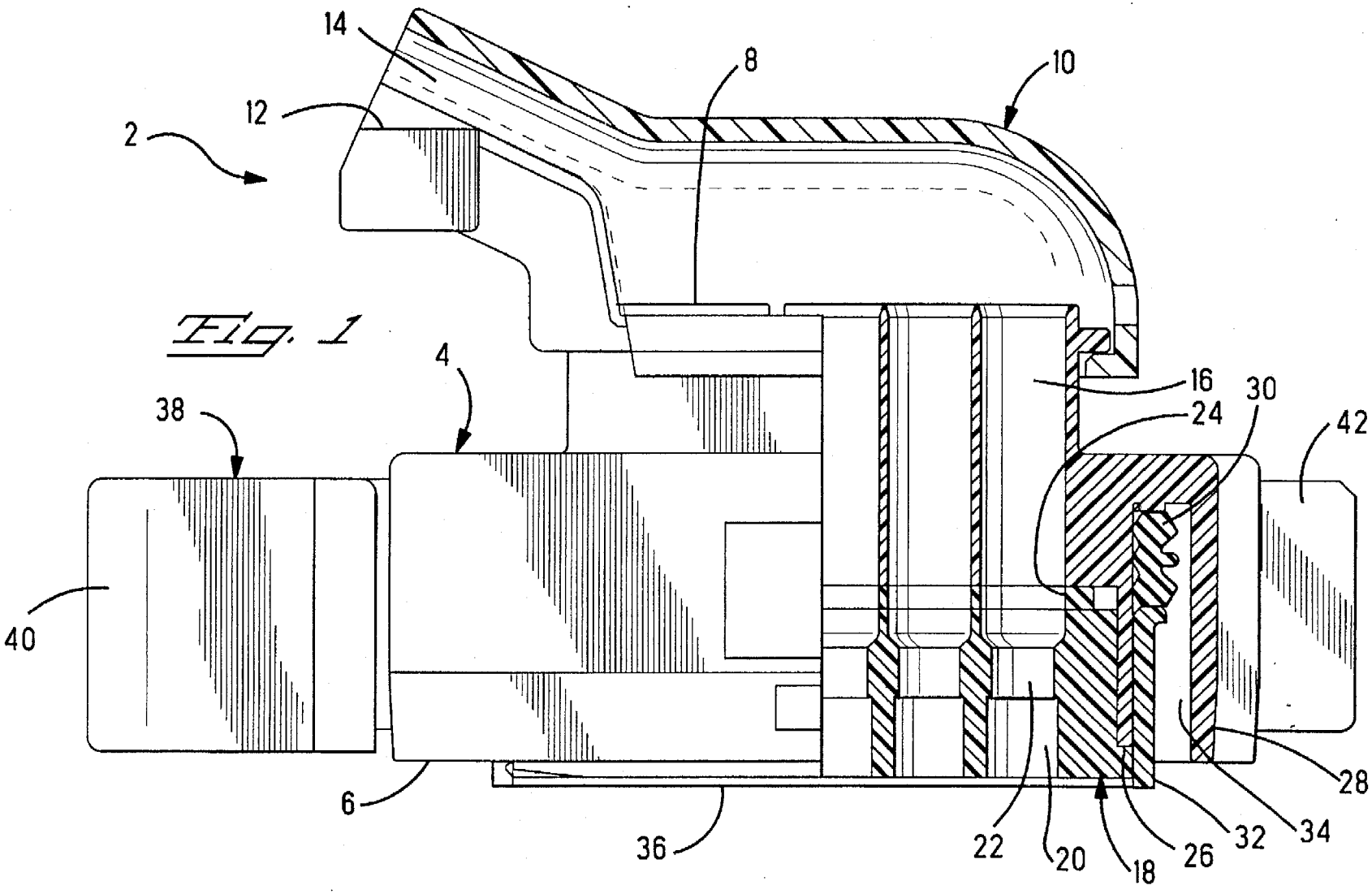
FIG. 1 is a partially cut-away side view of an electrical connector half incorporating a mating slide according to the present invention.

With reference first to FIG. 1, and electrical connector incorporating the present invention is shown generally at 2. The electrical connector 2 includes a main body portion 4 having a mating side 6 and a wire receiving side 8. A transversely sliding cover 10 slides over the main body portion 4 to cover the wire receiving face 8. The main body portion 4 includes a saddle 12 which interacts with the cover 10 to form a side entry 14 for receiving the conductors or wires into the main body portion 4. The main body 4 includes a plurality of terminal receiving cavities 16 extending into the body from the wire receiving face 8. Advantageously, the terminal receiving cavity 16 may be configured to enable individual wire seals to be utilized about the conductors of the cable (not shown).

The terminal receiving cavity 16 is further defined by a terminal block 18 which includes a cavity portion 20 extending therethrough that aligns with the terminal receiving cavity 16 of the body portion 4. The cavity portion 20 is configured with a reduced diameter section 22 such that shoulders are formed for engagement by locking lances of the contact (not shown) to be inserted therein. A secondary locking member 24 is positioned between the body portion 4 and the terminal block 18. The secondary locking member 24 is movable between an unlocked position, as shown in FIG. 1, and a locked position where at least a portion of the secondary locking member 24 blocks the cavity 16 and 20, thereby captivating a contact inserted therein. The terminal block 18 is received within a seat defined by an inner shroud wall 26 and may be retained in a snap-fit manner.

The housing body 4 includes an outer shroud wall 28 extending around the inner shroud wall 26. The inner shroud wall 26 carries a seal 30 which is held in place by a locking member 32 in order to form a sealed connection with a mating connector (not shown). The outer shroud wall 28 and the locking member 32 when combined with the seal 30, form and annular cavity 34 for receiving a shroud of a mating connector half (not shown) in a sealed manner. The annular cavity 34 is open about the mating face 36 of the mating block 18, wherein the complementary contacts of the other connector half are received.

Figure 2:
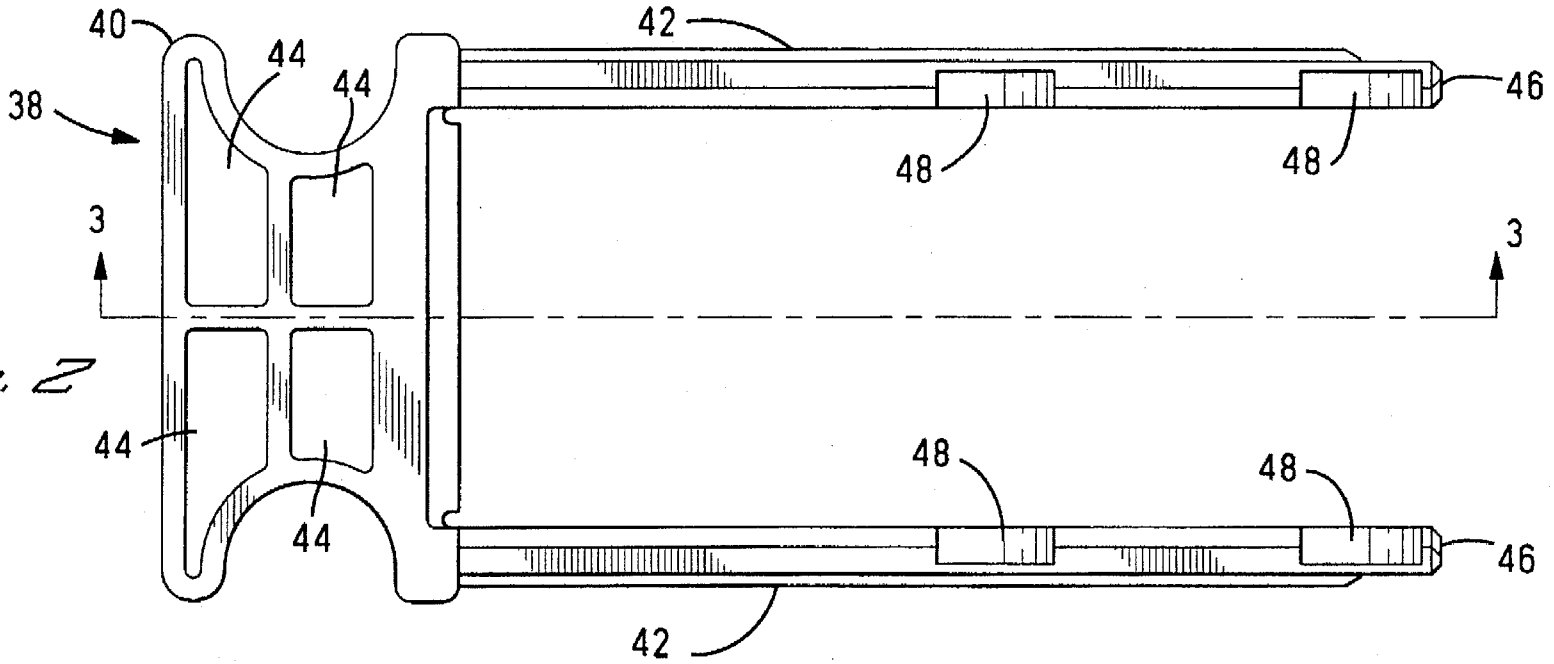
FIG. 2 is a lower view of the mating slide incorporated into the electrical connector half of FIG. 1.

The electrical connector half 2 carries a mating or actuating slide 38. The mating slide 38 has a gripping portion 40 and two spaced apart arms 42 extend parallel from the gripping part 40 in a U-shaped manner, as best seen in FIG. 2. The parallel arms 42 are received in a sliding manner in a channel (not shown) formed within the outer shroud portion 28 of the main connector body 4, whereby linear movement of the slide, transverse to the direction of insertion is possible. The channel prevents non-transversal displacement of the slide 38 and, as the arms 42 are carried in the outer shroud wall 28, the integrity of the sealed fit with the mating connector half is not adversely effected.

With reference now to FIG. 2, a bottom view of the mating slide 38 is shown. The gripping portion 40 is configured for easy engagement and manipulation and includes four relieved sections 44 to minimize the amount of material required. Opposing arms 42 extend from the gripping portion 40 opposite one another to free ends 46. Disposed along each of the arms are entry openings 48 configured to receive mating lugs 68*a,b* (FIG. 4) that are part of the mating connector.

Figure 3:
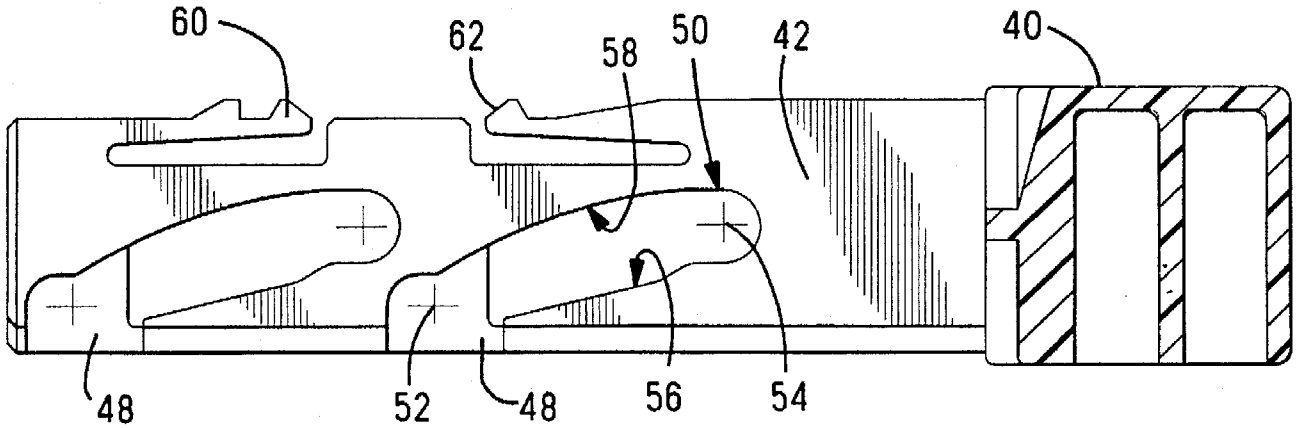
FIG. 3 is a sectional view of the mating slide of FIG. 2 taken along lines 3—3.

With reference now to FIG. 3, the entry portion 48 is continuous with a camming slot 50 having a first end point 52 and a second end point 54 defining disengaged and engaged positions respectively. As the second end point 54 is set further into the leg 42 than the first end point 52, when the locking lug 68*a,b* of the mating connector half is received within the camming slot 50 and the mating slide 38 is moved transversely, the mating connector halves are drawn together. As the connectors are being mated, the lug will travel along a lower surface 56 and when they are being disengaged, they will travel along an upper surface 58. These surfaces 56,58 will be described in detail below with reference to FIG. 4. Each arm 42 of the mating slide includes a pair of resilient cantilevered latches 60,62 that engage corresponding catches (not shown) on the main body portion 4 along the channels in the outer shroud 28. To establish and maintain both the locked and mated position and the unlocked position where mating and demating may occur, thereby assuring the integrity of the interconnection and that the mating slide 38 will remain within the connector assembly prior to mating in a position suitable for intermating.

Figure 4:
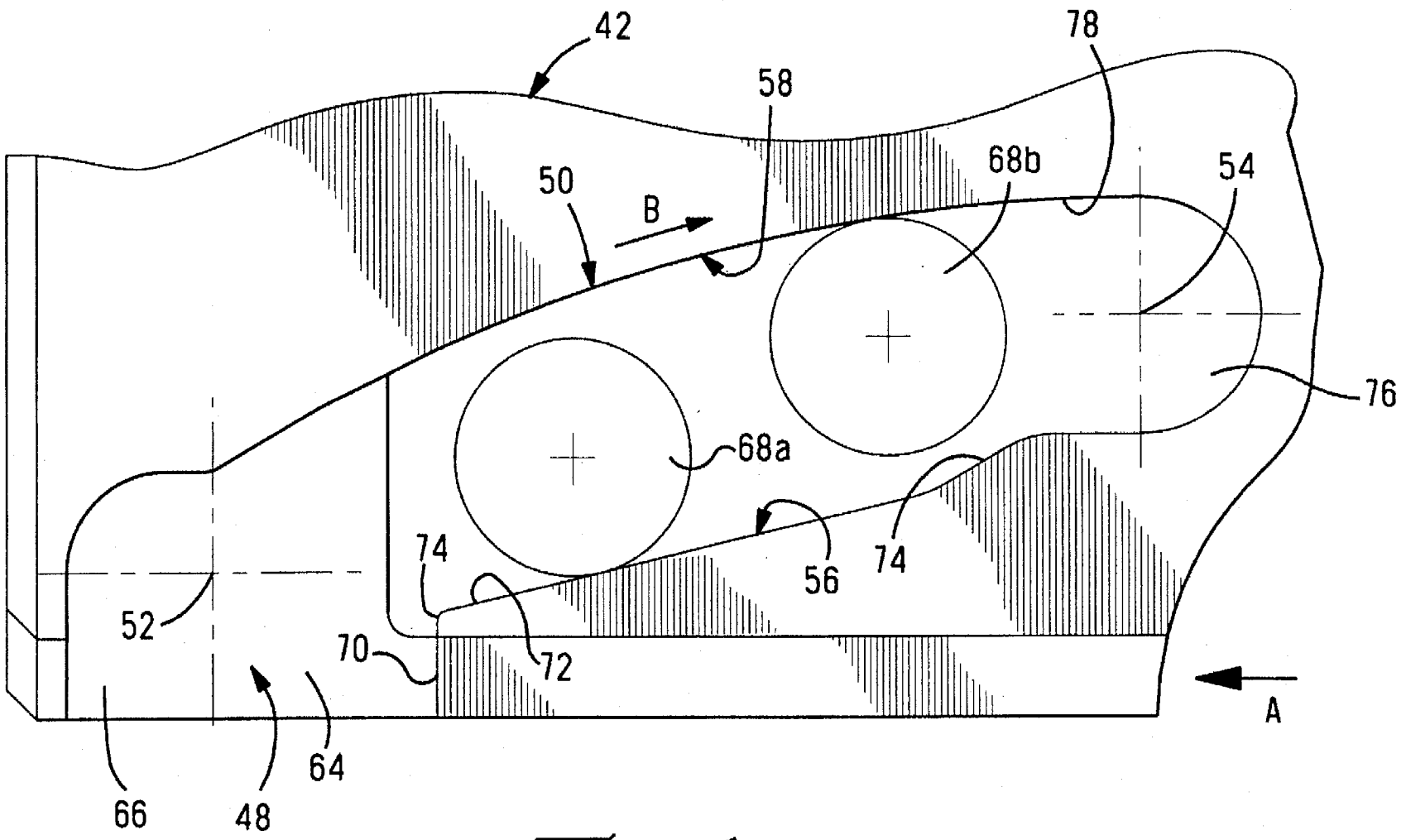
FIG. 4 is a detail of one of the camming slots shown in FIG. 3.

With reference now to FIG. 4, the camming groove 50 will be described in detail. The entry portion 48 includes a mating section 64 and an exit section 66. When a lug 68*a* of a mating connector half is received within the entry portion 48, it enters along transverse wall 70 and typically is mated by hand until initial engagement with each other. At this position, the lugs 68*a* would be at least above the extension of a camming surface 72 which intersects with the transverse wall 70 at point 74. The mating slide is then actuated in the direction of Arrow A causing the camming surface 72 to be disposed under the lug 68*a*. The camming surface 72 is disposed at angle less than the angle defined by a line extending between the first and second end points 52,54. This relatively shallow camming surface 72 provides mechanical advantage when the contacts and connector housings are initially being mated. The difference is made up in a steeper section 74 which has an angle greater than that defined by the end points 52,54 in order to provide the necessary displacement of the lug 68*a* so that it enters into the mated region 76. Obviously, it would be advantageous to provide tangential blending between the camming surface 72 and the steeper section 74 and the mated seat 76 to assure smooth operation of the mating slide.

Opposite the mating surface 56, the camming groove 50 includes the demating surface 58. The demating surface 58 is a arcuate section tangential with the seat section about the second point. In response to movement of the slide 38 in the direction of arrow B, the camming lug 68*b* moves along the arcuate section 78 until it enters the demating portion 66 of the entry 48 where the connector halves can be separated. It is during demating, that the initial forces required are the largest. This is because it is necessary to overcome the forces associated with the static frictional forces exerted thereupon. As the arcuate section 78 has a large radius and is tangential to the seat 76, initially there is very little displacement in the direction perpendicular to the transverse motion of the slide along arrow B. The displacement then increases along the curve of the arcuate section 78 in response to the translational movement. The lug 68*b* is finally expelled into the demating section 66 of the entry way 48 about the first point 52.

While in the above described embodiment, the mating slide 40 includes the camming groove 50 and is transversely displaceable relative to the mating connector halves. The lug is fixed on the mating connector half (not shown). It would be obvious to one skilled in the art to reverse this configuration without any effect on the operability of the invention. Also more compound surfaces are envisioned as possible for the mating surface 56 and/or the demating surface 58.

Advantageously, the present invention provides a camming slide/actuating slide incorporated into one connector that cooperates with a mating connector to draw the connector pair together, where a camming lug is driven along one side of a camming slot in response to mating the connectors and the camming lug is driven along another side of the camming slot in response to demating the connector pair, wherein the surfaces of the camming slot are profiled to provide the greatest mechanical advantage at the location of the largest resistance. The present invention may be incorporated into existing connectors. The present invention provides mechanical advantage for smooth operation and ease in mating. The present invention provides for customized mating and demating surfaces.

We claim:

1. An electrical connector for mating with a mating connector, wherein the electrical connector comprises a camming slide incorporated therein that cooperates with the mating connector to draw the connectors together, wherein response to mating displacement of the camming slide that is a linear movement transverse to the mating displacement, a camming lug is driven within a camming slot and in response to de-mating displacement of the camming slide that is a linear movement opposite the linear movement for mating the camming lug is driven oppositely within the camming slot, where in response to the linear movement of the camming slide effecting the mating displacement, the camming lug is driven along a first camming surface and in response to the linear movement effecting de-mating displacement, the camming lug is driven along a second camming surface where the second camming surface is a curved path profiled to provide the least de-mating displacement at the start of the de-mating linear movement of the camming slide.

2. The electrical connector of claim 1, wherein the first camming surface and the second camming surface have different profiles.

3. The electrical connector of claim 1, wherein the first camming surface includes linear segments.

4. The electrical connector of claim 1, wherein the first and second camming surfaces are profiled to provide less displacement of the mating connectors relative to the displacement of the camming slide where the corresponding resistance is greater than the displacement where the resistance is less.

5. The electrical connector of claim 1, wherein the camming side is of U-shaped construction having opposing arms containing camming slots therein and the arms extend from a gripping portion.

6. The electrical connector of claim 1, wherein the camming slot includes an entry portion for receiving the camming lug as the connectors are mated and a locked seat position where the camming lug is seated when the connectors are mated, the second camming surface curved profile being tangent to the locked seat position.

7. The electrical connector of claim 1, wherein the camming slot is part of the camming slide.

* * * * *